United States Patent [19]

Gross

[11] 4,204,453

[45] May 27, 1980

[54] DEVICE FOR AUTOMATIC TONAL ACCOMPANIMENT IN ELECTRONIC MUSICAL INSTRUMENTS

[75] Inventor: Ulrich Gross, Geldrop, Netherlands

[73] Assignee: U.S. Philips Corporation, New York, N.Y.

[21] Appl. No.: 862,006

[22] Filed: Dec. 19, 1977

[30] Foreign Application Priority Data

Dec. 29, 1976 [DE] Fed. Rep. of Germany ..... 2659291

[51] Int. Cl.[2] ..... G10H 1/02

[52] U.S. Cl. ..... 84/1.24; 84/1.03; 84/DIG. 12; 84/DIG. 22

[58] Field of Search ..... 84/1.03, 1.24, DIG. 2, 84/4, 12, 22

[56] References Cited

U.S. PATENT DOCUMENTS

| | | | |
|---|---|---|---|
| 3,567,838 | 3/1971 | Tennes | 84/1.03 |
| 3,706,837 | 12/1972 | Arsem | 84/1.24 |
| 3,740,449 | 6/1973 | Southard | 84/1.03 |
| 3,889,568 | 6/1975 | Amaya | 84/1.03 |
| 3,918,341 | 11/1975 | Bunger | 84/1.03 |
| 3,986,424 | 10/1976 | Sakashita | 84/1.03 |
| 4,072,078 | 2/1978 | Shallenberger | 84/1.03 |

*Primary Examiner*—Gene Z. Rubinson
*Assistant Examiner*—Leonard W. Pojunas, Jr.
*Attorney, Agent, or Firm*—Thomas A. Briody; William J. Streeter; Bernard Franzblau

[57] ABSTRACT

A device for automatic tonal accompaniment in musical instruments equipped with a rhythm unit, the fundamental, the quint, or another tone related to a chord being held and/or the chord itself becoming available in a predetermined sequence in a selected rhythm. For at least one tonal key a chord sensor is provided at whose output a signal appears in the presence of a chord and an associated switching device connected is thereto which in the absence of a chord switches the chord sensor to detection of individual tones.

8 Claims, 12 Drawing Figures

DEVICE FOR AUTOMATIC TONAL ACCOMPANIMENT IN ELECTRONIC MUSICAL INSTRUMENTS

Figure 1:
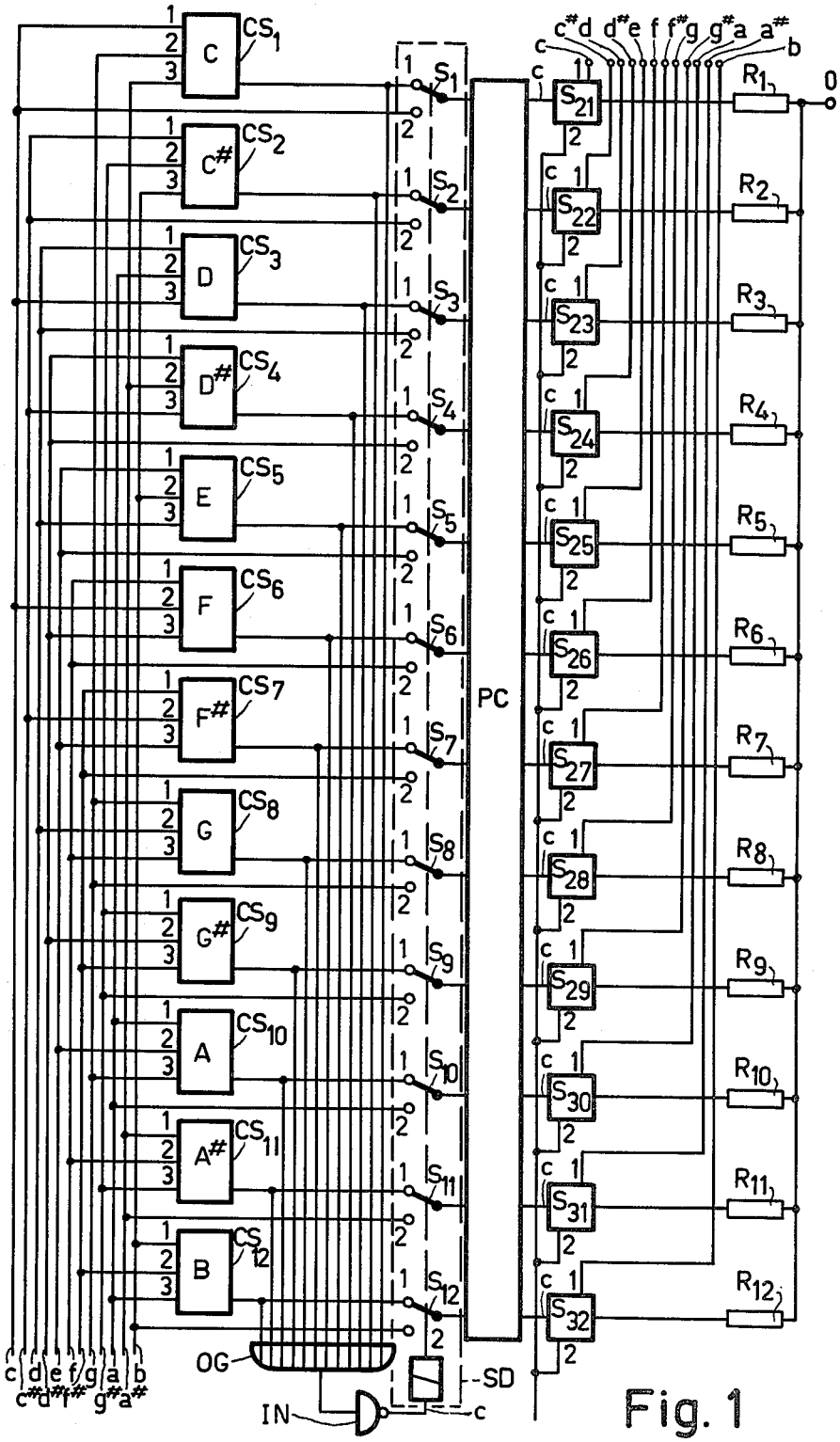

The invention relates to a device for automatic tonal accompaniment in electronic musical instruments equipped with a rhythm unit, the fundamental, the quint or another tone related to specific chords being held and/or the chord itself becoming available in a predetermined sequence in the selected rhythm.

Such a device is known from U.S. Pat. 3,567,838. This device selects the highest and the lowest tone from the chords being held and reproduces these tones alternately with the chords.

When only one individual tone is struck, no chord is found with that device, which gives rise to an annoying break in the accompaniment.

It is an object of the invention to provide a device which fills this gap when an incomplete chord or even a separate tone is struck.

According to the invention this object is achieved in that for at least one tonal key there is provided a chord sensor which identifies the character of the chord, for example a major, minor or seventh chord, and at whose output a signal appears in the presence of a chord, while a switching device is added to the associated chord sensor which switches the chord sensor to identification of individual tones in the absence of a chord.

A device in accordance with the invention includes a chord sensor for each tonal key having inputs to which are applied the tones of the chords to be identified. The output of each chord sensor is connected both to a first input of one of twelve switches which together constitute the switching device and to an input of an OR-circuit. The switches have second inputs to which a key signal of a preselected tone of the chord, for example the fundamental, is applied. The output of the OR-circuit is connected to the control inputs of all the switches and the outputs of each of the switches lead to an individual input of a priority of circuit. An output is provided for each input of the priority circuit and each output of said priority circuit leads to the control input of a switch having a first input to which the corresponding tone is applied and a second input to which the control pulse from the rhythm unit is applied the outputs of these switches are interconnected via an OR-circuit.

Suitably, such a device is designed so that the switches consist of an AND-gate circuit having a control input connected to an output of the priority circuit, a second input to which the pulses from the rhythm unit are applied and a first input to which a tone signal is applied.

For the alternate reproduction of fundamental and alternating bass it is of advantage that each switch comprises two AND-gate circuits whose control inputs are both connected to an output of the priority circuit. The signal corresponding to the fundamental of the chord sensor associated with the switch is applied to the first input of the first gate circuit, the fundamental bass pulses from the rhythm unit is applied to the second input, and the signal corresponding to the alternating bass of the chord sensor associated with the switch is applied to the first input of the second gate circuit and the alternating bass pulses from the rhythm unit to the second input.

Another embodiment of this device in accordance with the invention comprises:

(a) a first 12-bit cyclic shift register having twelve parallel inputs, twelve corresponding outputs, a parallel enable input and a clock input, (b) a chord sensor which identifies the character of a chord being held (for example major, minor or seventh chord), (c) a HF clock generator having at least one input and an output, (d) a second 12-bit cyclic shift register having twelve parallel inputs, twelve corresponding outputs, one parallel enable input and one clock input, (e) twelve first gate circuits each having two inputs and one output, (f) a second gate circuit having twelve inputs and an output, and (g) a control unit.

In this embodiment the outputs of the manual and/or pedal key switches associated with the manual and/or pedal keys of at least one octave are directly or indirectly connected to the parallel inputs of the first 12-bit cyclic shift register and upon each control pulse from the rhythm unit which is applied to the input of the first 12-bit cyclic shift register the pattern of the chord being held is transferred in parallel to said first 12-bit cyclic shift register and those outputs of the first 12-bit cyclic shift register, to which the tones of the chords of a single tonal key (C or C-sharp or D . . . or B) correspond, lead to inputs of the chord sensor, while the output of the HF clock generator is connected to:

(1) the clock input of the first 12-bit cyclic shift register, each HF clock pulse shifting the information at the driven parallel inputs one position further, which information corresponds to the pattern of the chord being held, (2) the clock input of the second 12-bit cyclic shift register into which one single bit is entered upon each control pulse via one of its 12 parallel inputs, each HF clock pulse shifting the information at the driven parallel input one position further, while those outputs of the first 12-bit cyclic shift register to which the tones of the chord of a single tonal key to be reproduced correspond, lead to inputs of the chord sensor. A signal appears at the chord sensor output when a chord is detected, which signal is applied to the control unit which is connected to the input of the HF clock-generator which is rendered effective upon each control pulse so that this HF clock-generator is rendered ineffective via this input. Each output of the second 12-bit cyclic shift register is connected to a first input of an associated separate first gate circuit having a second input to which a tone signal is applied. The outputs of these first gate circuits are connected to the corresponding inputs of the second gate circuit at whose output a tone signal is available, while a counter is provided which is connected to the switching device which, after twelve clock pulses from the HF clock generator, causes the switching device to switch the chord sensor to tone identification.

In a further embodiment of the invention the outputs of the counter are connected to a decoder at whose output a signal appears upon the twelfth HF clock pulse. This output is connected to the input of the switching device whose output is connected to an input of the chord sensor for switching to tone identification and whose reset input is connected to a stop input of the control unit. The switching device is reset when a tone is detected.

In a further embodiment of a device in accordance with the invention the output of the chord sensor leads to an input of a chord memory which is included in the control unit and which stores the identified chord, and via a second output of the control unit the output of said chord memory leads to a reset input of a counter whose clock input is also connected to the output of the HF clock generator, as well as to a comparator circuit. The comparator includes first inputs connected to the corresponding outputs of the counter and second inputs connected to a switch which changes-over upon each control pulse. The output of the comparator circuit is connected to a third input of the control unit so that alternately when that count of the counter is reached which corresponds to the fundamental or to another tone, the HF clock generator is rendered ineffective while via a decoder the third and the fourth output of the counter are on one hand connected to the input of the switching device and to the first input of a NAND-circuit, whose second input leads to an input of the chord sensor, to the output of the switching device and to the reset input of the switch, and on the other hand via an AND-circuit is connected to the reset input of the counter, while the output of the NAND-circuit leads to the reset input of the second 12-bit cyclic shift register, to the reset input of the switching device and to a stop input of the control unit. The output of the comparator circuit is also connected to the reset input of the switching device.

In yet another embodiment of the device in accordance with the invention the second 12-bit cyclic shift register serves as counter and decoder for switching to tone identification, the twelfth parallel output of said register being connected to an input of the switching device.

Figure 2A:
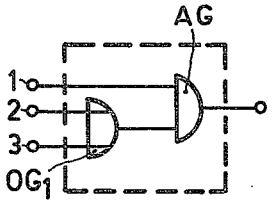
Figure 2B:
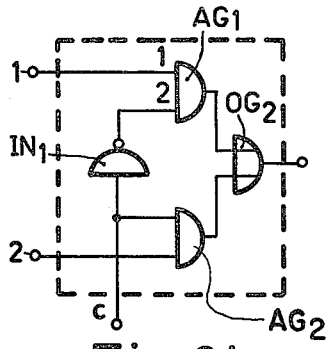
Figure 2C:
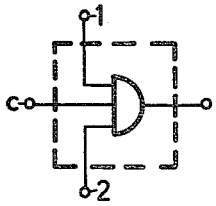
Figure 2D:
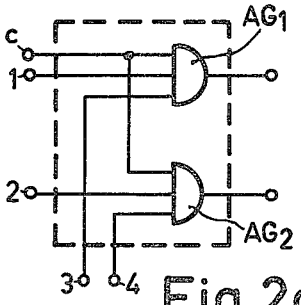
Figure 2E:
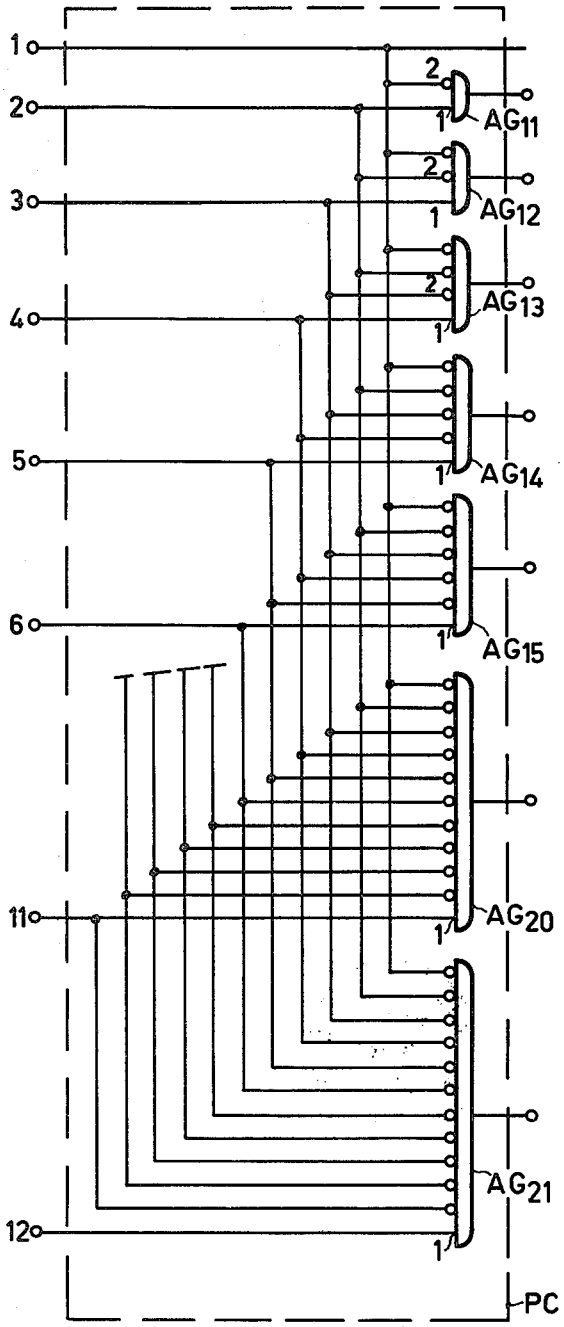
Figure 3:
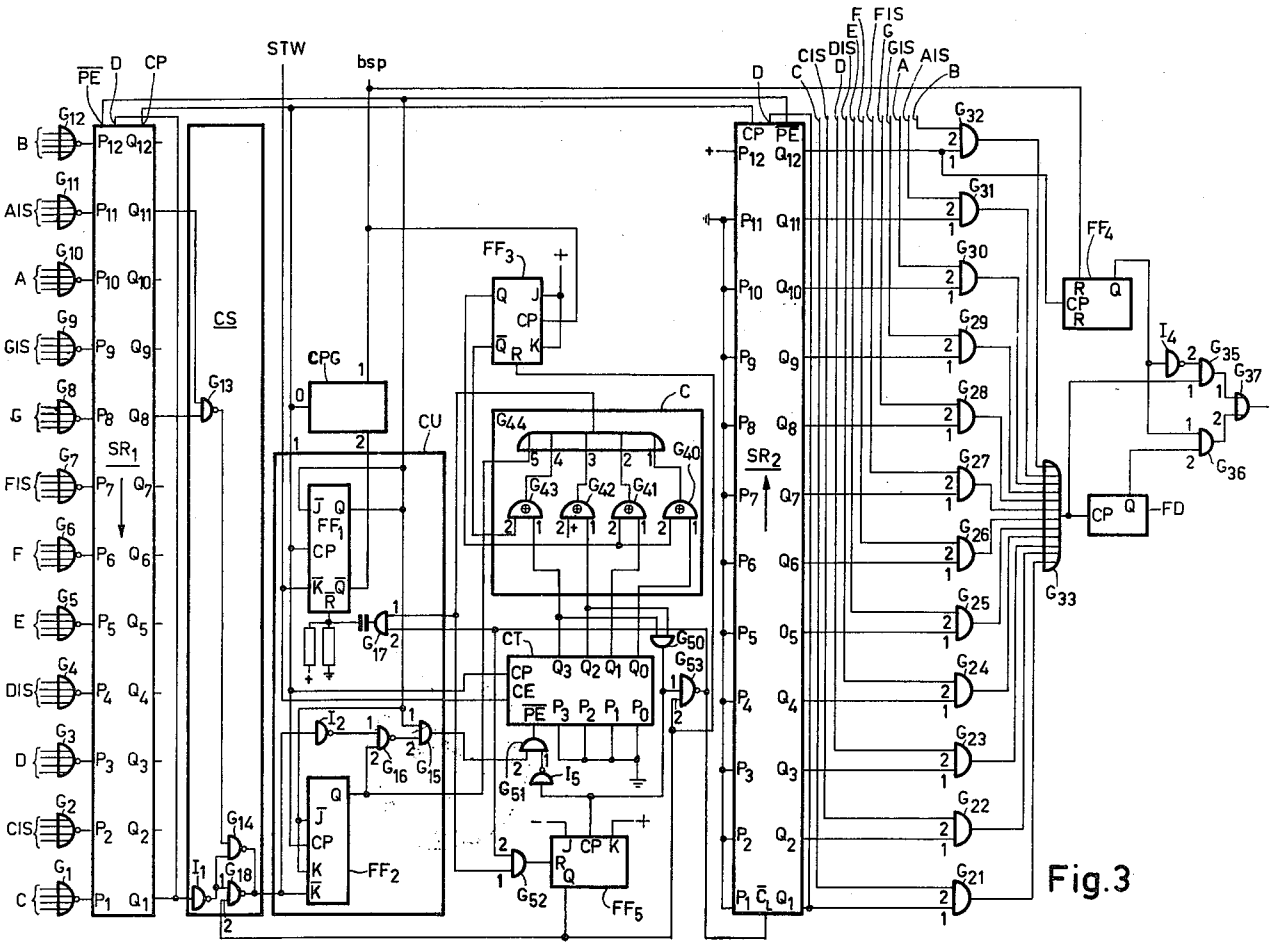
Figure 4A:
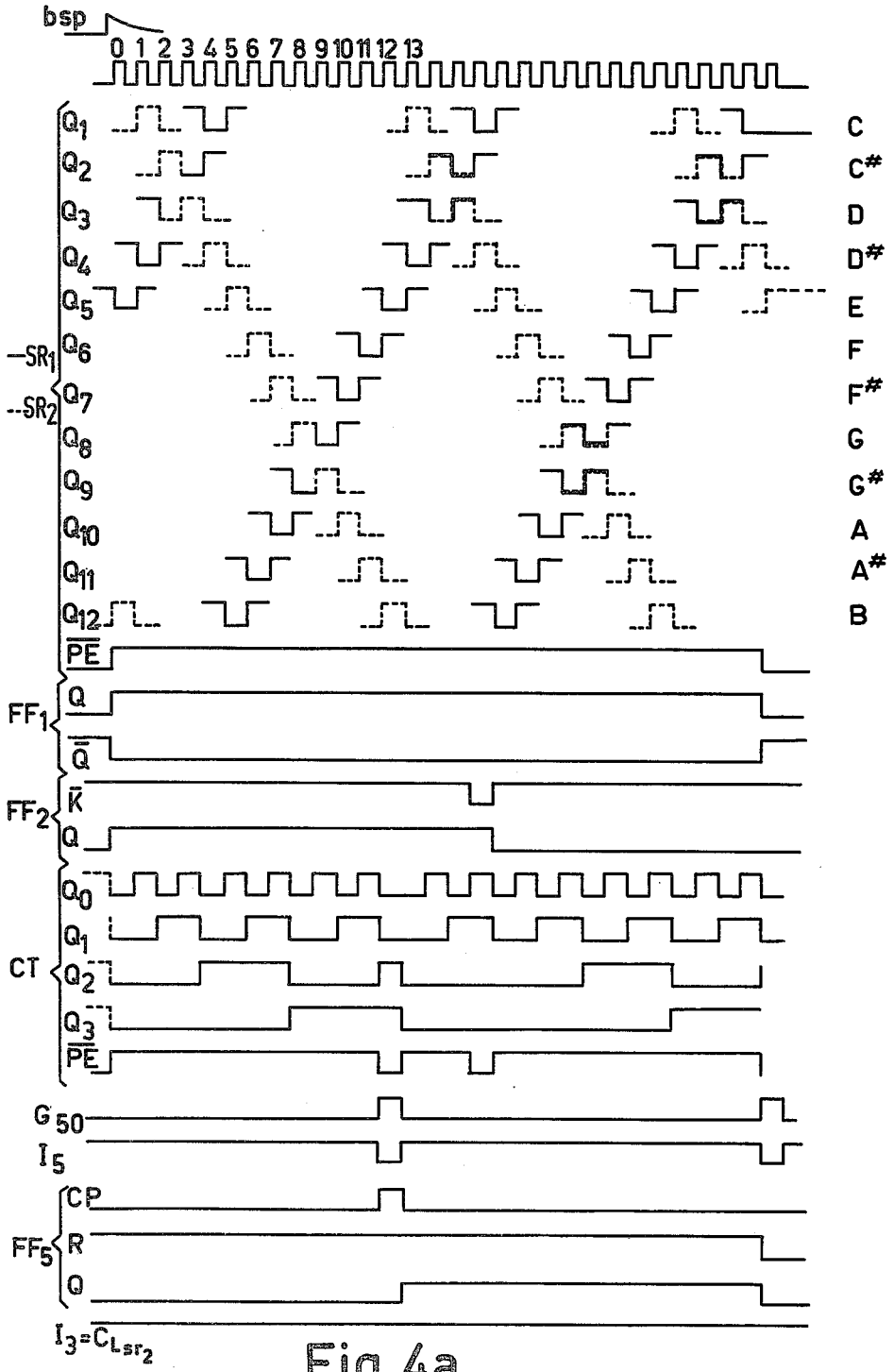

The invention will now be described in more detail with reference to the accompanying drawings, in which:

FIG. 1 shows a device with a chord sensor for every tonal key,

FIG. 2*a* shows a circuit arrangement of a chord sensor,

FIG. 2*b* shows a switch of the switching device,

FIGS. 2*c* and 2*d* represent examples of the switch,

FIG. 2*e* shows a priority circuit,

FIG. 3 shows a device with one chord sensor,

FIG. 4*a* shows the associated pulse-time diagram when a key is depressed, and

Figure 4B:
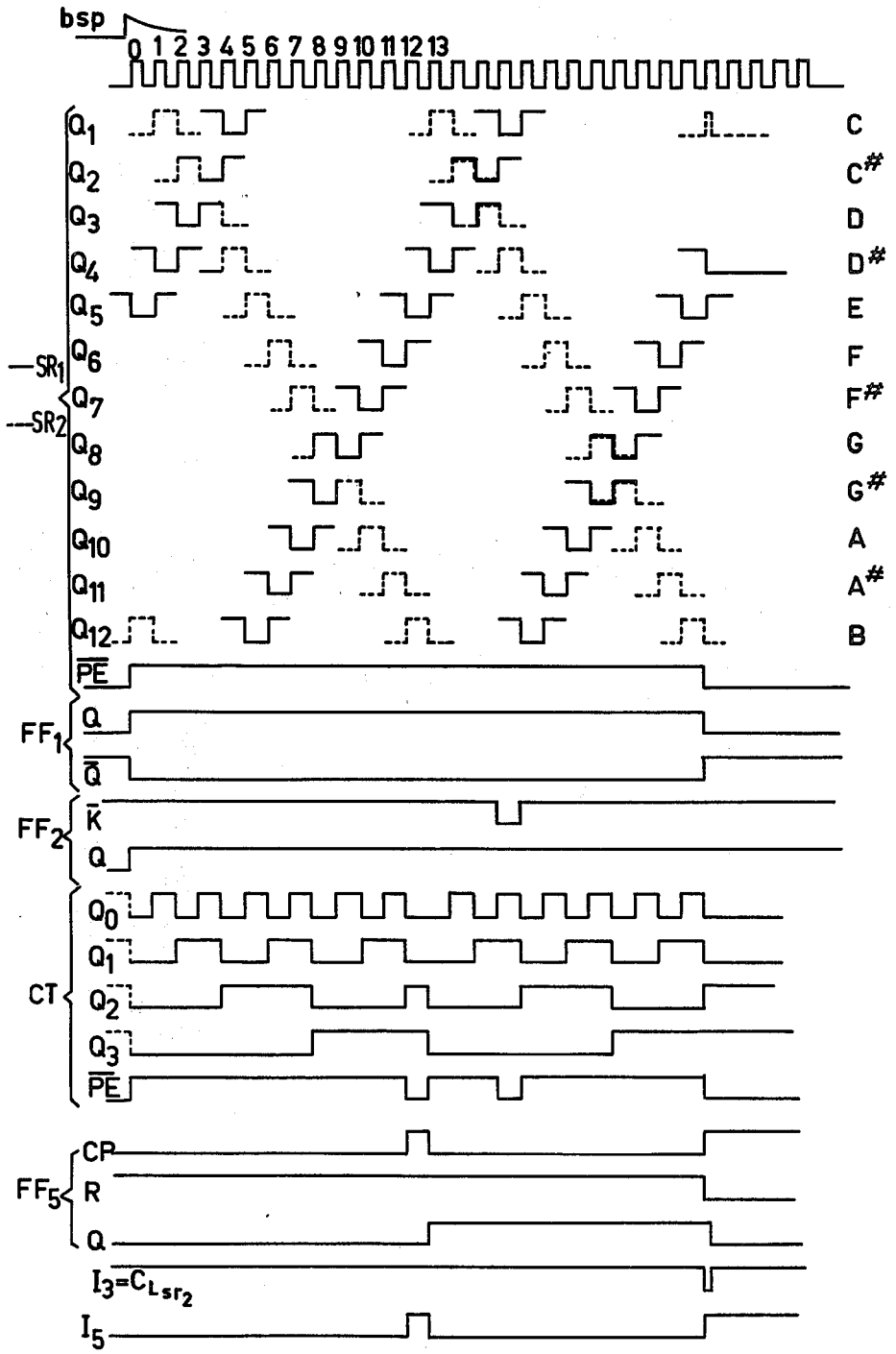
Figure 5:
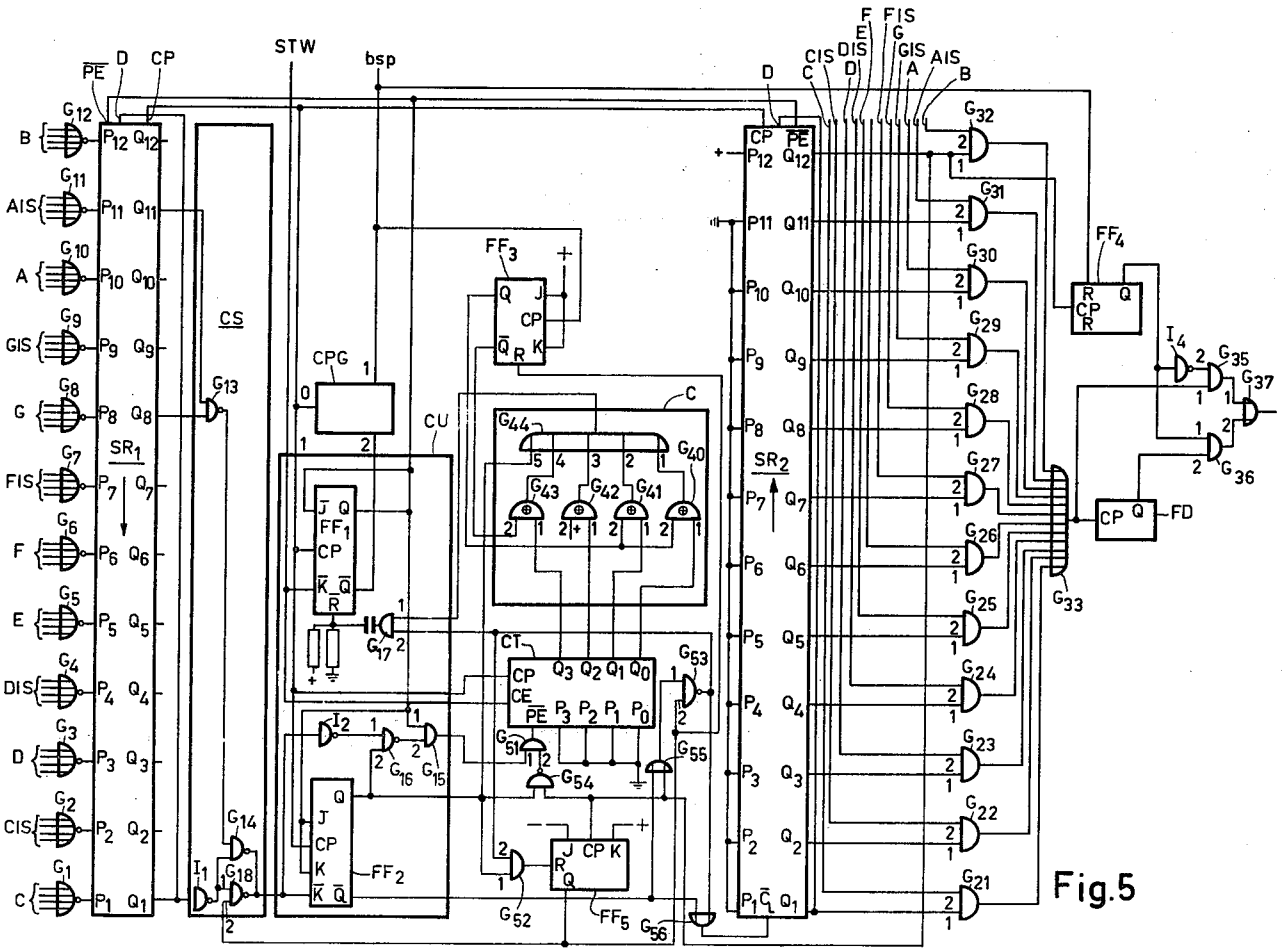
Figure 6A:
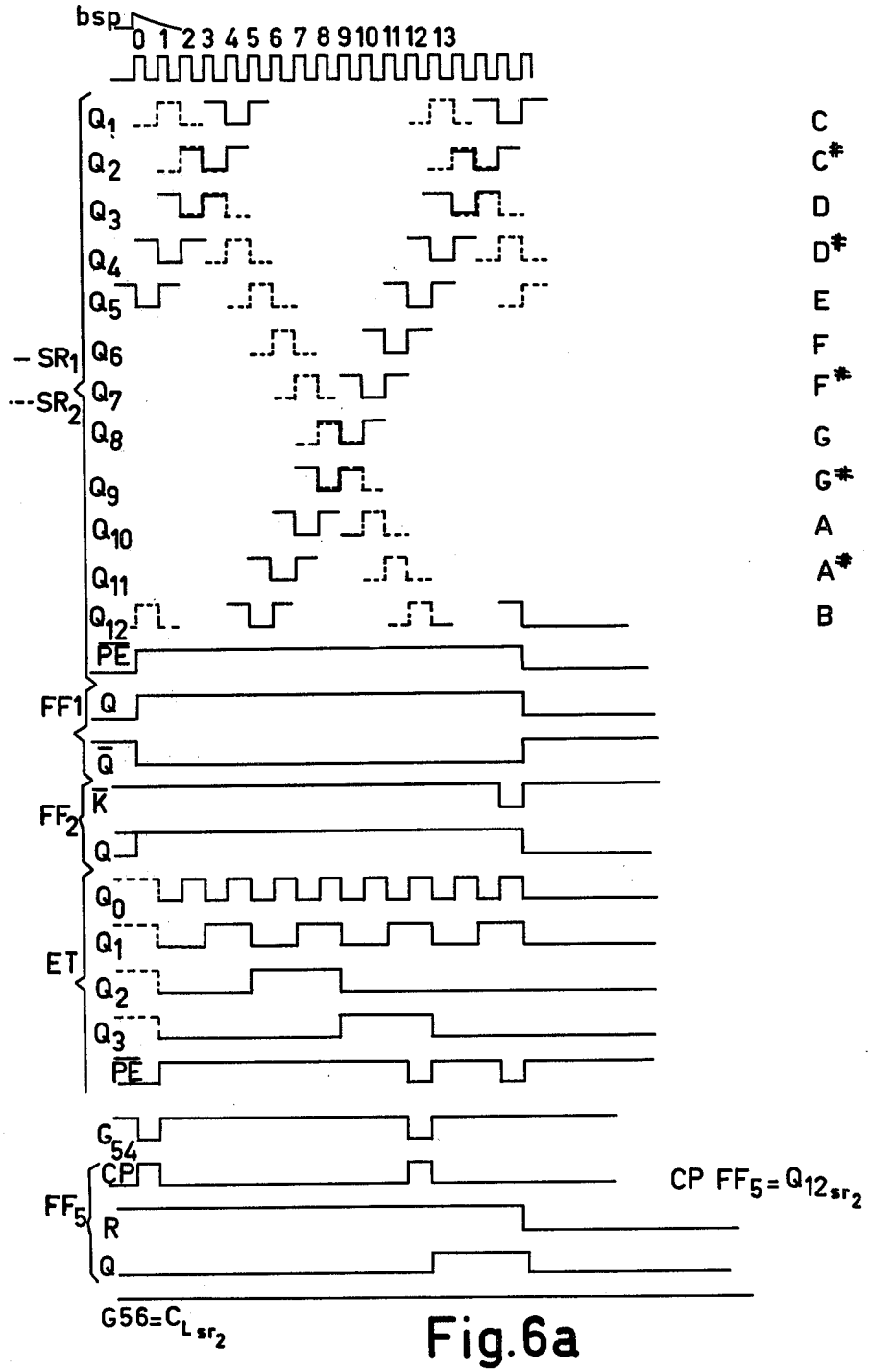
Figure 6B:
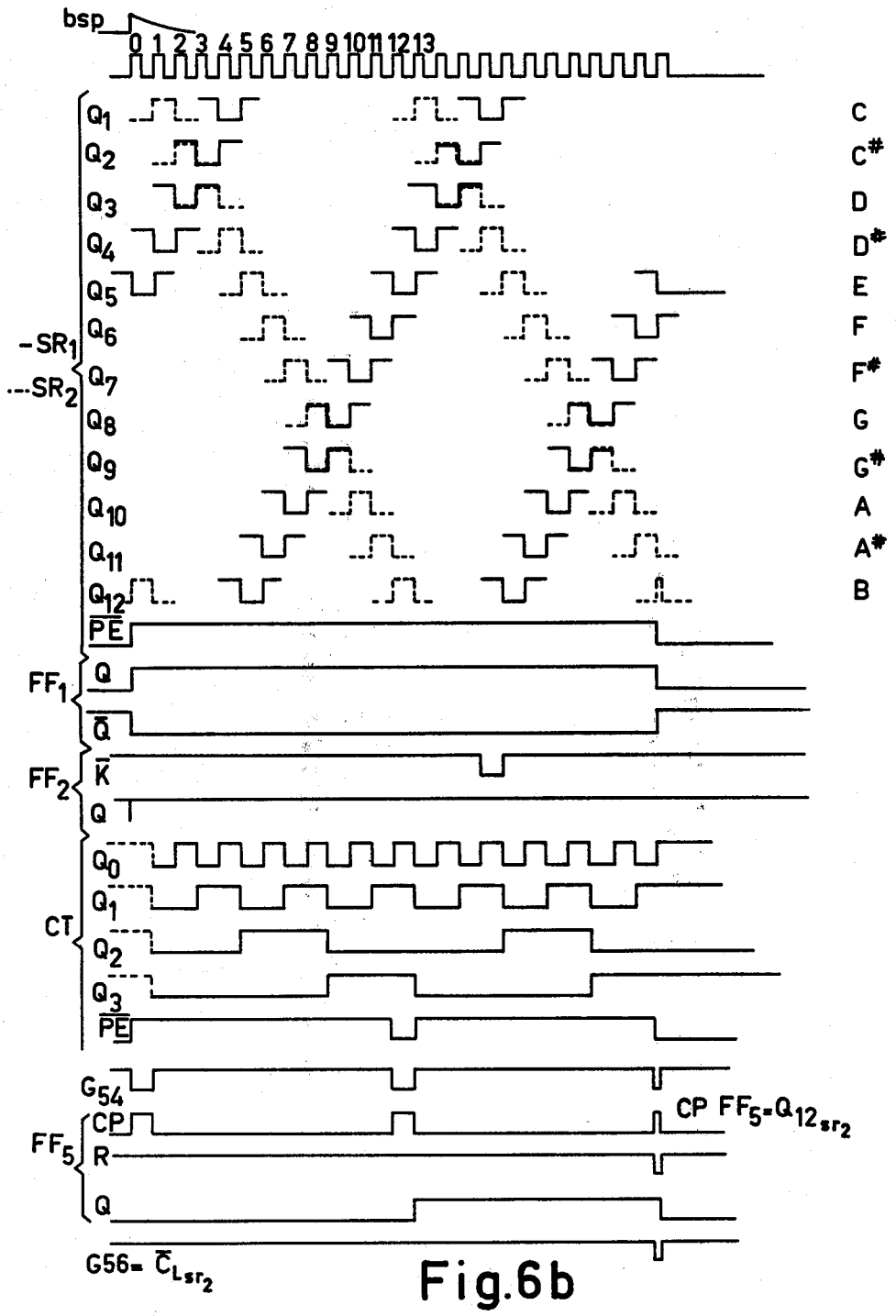

FIG. 4*b* shows this diagram when no key is depressed,

FIG. 5 shows a device in which the second 12-bit cyclic shift register serves as counter for switching to tone identification, while FIG. 6*a* shows the associated pulse-time diagram when a key is depressed, and FIG. 6*b* shows said diagram when no key is depressed.

In FIG. 1 the signals corresponding to the keys being held are applied to the inputs of the chord sensors $CS_1 \ldots CS_{12}$, the inputs 1 corresponding to the fundamental, the inputs 2 to the fifth and the inputs 3 to the seventh of the tonal key of the chord sensor.

The chord sensors $CS_1 \ldots CS_{12}$ are designed so that when a signal is applied to their inputs 1 and 2, or 1 and 3, or 1,2 and 3 a signal appears at the outputs of the chord sensors. The outputs of the chord sensors each lead to an input of an OR-gate OG and to a first input of an individual switch $S_1 \ldots S_{12}$, the switches $S_1 \ldots S_{12}$ together constituting the switching device SD. Via an inverter IN the output of the OR-gate OG leads to the common control input C of the switches $S_1 \ldots S_{12}$, to whose second inputs the signal corresponding to the fundamental of the associated chord sensor is applied. The outputs of the switches $S_1 \ldots S_{12}$ are each connected to an input of a priority circuit PC. For each input of the priority circuit PC there is provided an associated output, which leads to a first control input C of a switch $S_{21} \ldots S_{32}$, to whose first input the fundamental of the associated chord sensor is applied and to whose second input control pulses from the rhythm unit are applied. The outputs of these switches $S_{21} \ldots S_{32}$ are connected to each other via an OR-gate constituted by the resistors $R_1 \ldots R_{12}$. When a major, minor or seventh chord is struck, signals from the key switch are applied to the inputs of the chord sensor so that at the output of one of the chord sensors a signal appears. This signal also appears at the output of the OR-gate OG, but no longer at the output of the inverter IN, so that the switches $S_1 \ldots S_{12}$ are not changed over and consequently their first inputs 1 remain connected to their outputs and the signal is directly transferred to the corresponding output of the priority circuit PC and is applied to the switch $S_{21} \ldots S_{32}$. When the rhythm unit supplies a pulse to the second input of the switches $S_{21} \ldots S_{32}$ the corresponding tone signal is transferred to the output O via its resistor.

If another chord or a single tone is struck, no signal appears at any of the outputs of the chord sensors $CS_1 \ldots CS_{12}$, so that no signal appears at the output of the OR-gate OG, but only at the output of the inverter IN, as a result of which a signal is applied to the control input C of the switching device SD, which comprises the switches $S_1 \ldots S_{12}$. The switches $S_1 \ldots S_{12}$ are thereby changed over so that via the second inputs of the switches $S_1 \ldots S_{12}$ a separate tone is applied to those inputs of the priority circuit PC which correspond to the depressed key. The priority circuit PC is designed so that only the lowest ranking signal is transferred to its output and upon the appearance of a control pulse from the rhythm unit the tone corresponding to this signal is passed through by its switch $S_{21} \ldots S_{32}$ and becomes available at the output O, so that breaks in the accompaniment are avoided.

FIG. 2*a* shows how a chord sensor $CS_1 \ldots CS_{12}$ can be formed with the aid of gates. The chord sensor shown only identifies the major, minor and seventh chords. The fundamental is transferred to one input 1 of the chord sensor which is connected to one input of the AND-gate and AG. The fifth or the seventh chords are applied to the inputs 2 and 3 respectively of the chord sensor which are connected to first and second inputs of the OR-gate $OG_1$ and thence to the other AND-gate input via said OR gate $OG_1$.

FIG. 2*b* shows how a switch $S_1 \ldots S_{12}$ can be formed with the aid of three gates and one inverter. When a signal appears at the first input of the switch and thus at the first input of the first AND-gate $AG_1$, this signal is only transferred to the output via the OR-gate $OG_2$ when no signal appears at the control input C, because in this case a signal appears at the second input 2 of the AND-gate $AG_1$ via the inverter $IN_1$. When a signal is applied to the control input, the AND-gate $AG_1$ is closed and ANG-gate $AG_2$ is open so that a signal at the second input 2 of the switch is transferred to the output.

FIG. 2c shows how an AND-gate with three inputs can be used as a switch $S_{21} \ldots S_{32}$. The tone is applied to the input 1 and the control pulses from the rhythm unit are applied to the input 2, while the input c leads to the output of the priority circuit PC which corresponds to the fundamental. In this case it is only possible to transfer a single tone to the OR-gate when a chord is struck.

FIG. 2d shows a circuit by means of which it is possible to alternately transfer the fundamental and the fifth, in that two inputs 3, 4 are provided which are connected to the rhythm unit, the control pulses for the fundamental being applied to the input 3 and the control pulses for the fifth to the input 4. The fundamental is applied to the input 1 and the fifth to the input 2, while the input C is connected to the output of the priority circuit PC which corresponds to the fundamental. These switches consequently have two outputs, all outputs being connected to the output O via the OR-gate.

FIG. 2e shows how a priority circuit PC may be formed. When a signal appears at several inputs, the lowest ranking signal must be transferred. This priority circuit comprises eleven AND-gates $AG_{11} \ldots AG_{21}$, to whose first input 1 the signal from the output of the switches $S_1 \ldots S_{12}$ is applied directly, while to the other inputs the inverted signal from the lower order inputs is applied. If a signal is applied to more than one input of the priority circuit PC, only the lowest ranking signal is transferred by the associated AND-gates $AG_{11} \ldots AG_{21}$, because the other signals are blocked by the lowest ranking signal. When for example the inputs 2 and 3 of the priority circuit PC receive a signal, the signal at the input 2 is transferred because no signal from the input 1 of the priority circuit PC appears at the second input 2 of the AND-gate $AG_{11}$. The signal at the input 3 of the priority circuit PC, however, is not transferred because the signal from input 2 of the priority circuit PC appears at the second input of the AND-gate $AG_{12}$, so that AND-gate $AG_{12}$ is closed. The first input of the priority circuit PC is connected directly to its output because the tone corresponding to this input has the highest priority.

In FIG. 3, which shows a circuit arrangement with only one chord sensor, the key switches of corresponding tones C, C-sharp . . . B are each connected to an input of a gate $G_1 \ldots G_{12}$ which takes the form of a NOR-circuit, which is the equivalent of an OR-gate in the inverted logic which is used, to whose outputs an input $P_1 \ldots P_{12}$ of a first 12-bit cyclic shift register $SR_1$ is assigned. The outputs $Q_1 \ldots Q_{12}$ of the first 12-bit cyclic shift register $SR_1$, which correspond to the tones of the chords to be reproduced of a single tonal key, lead to the inputs of a chord sensor CS.

In this example this key is the C and the outputs $Q_1$, $Q_8$ and $Q_{11}$ which belong to the major third, minor third and seventh chords, lead to the chord sensor CS, which in the present example consists of an inverter $I_1$ and two NAND-gates $G_{13}$ and $G_{14}$ respectively. Furthermore an HF clock generator CPG is provided, whose output O leads both to the clock input CP of the first 12-bit cyclic shift register $SR_1$ and to the clock input CP of a second 12-bit cyclic shift register $SR_2$. The outputs $Q_1 \ldots Q_{12}$ of shift register $SR_2$ are each connected to a first input 1 of a first gate circuit $G_{21} \ldots G_{32}$, which takes the form of an AND-gate to whose second input 2 the corresponding tone is applied. The outputs of the first gate circuits $G_{21} \ldots G_{32}$ lead to the inputs of a second gate circuit $G_{33}$ which takes the form of an OR-gate.

The output O of the HF clock generator moreover leads to a first input 1 of the control unit CU and the clock input CP of the counter CT. The control unit CU comprises two flip-flops (bistable multivibrators) $FF_1$ and $FF_2$ of the JK-type having clock inputs CP connected to the first input 1 of the control unit CU. The first output Q of the first flipflop $FF_1$ is connected to its J-input and the parallel enable inputs $\overline{PE}$ of the two 12-bit shift registers $SR_1$ and $SR_2$ and to both the $\overline{J}$ and the K-input of the second flip-flop $FF_2$ as well as the first input 1 of an AND-gate $G_{15}$. The second output $\overline{Q}$ of the first flip-flop $FF_1$ leads to the second input 2, the stop input, of the HF clock generator CPG.

The output of the chord sensor CS is connected both to a $\overline{K}$ input of the second flip-flop $FF_2$ which serves as a chord-detected memory and to the first input of a NAND-circuit $G_{16}$ via an inverter $I_2$. The output of the NAND-circuit $G_{16}$ leads to the second input 2 of the AND-gate $G_{15}$, whose output is connected to the second input 2 of the AND-gate $G_{51}$ having an output which leads to the parallel enable or reset input $\overline{PE}$ of the counter CT. The counter preset inputs $P_0$, $P_1$, $P_2$ and $P_3$ are interconnected and connected to ground. The outputs $Q_0$, $Q_1$, $Q_2$ and $Q_3$ of the counter CT each led to a first input 1 of and EXCLUSIVE OR circuit $G_{40}$, $G_{41}$, $G_{42}$ and $G_{43}$ which, in combination with an OR circuit $G_{44}$having inputs 1, 2, 3 and 4 connected to the outputs of the EXCLUSIVE OR circuits $G_{40} \ldots G_{43}$, make up a comparator circuit C. The output of the OR circuit $G_{44}$ leads both to the first input of the AND-gate $G_{17}$, whose output leads to the reset input $\overline{R}$ of the first flip-flop $FF_1$ via a differentiating circuit, and to the first input of the AND gate $G_{52}$. The outputs $Q_2$ and $Q_3$ of the counter CT are connected to the respective first and second inputs of the AND-gate $G_{50}$, the output of which leads to the first input 1 of the NAND-gate $G_{53}$, the output of which is connected to the reset input $\overline{C}_L$ of the second 12-bit shift register $SR_2$ as well as to the second inputs of the AND-gates $G_{17}$ and $G_{52}$. Moreover the output of the AND-gate $G_{50}$ leads to the clock input CP of a fifth flip-flop $FF_5$ and via an inverter $I_5$ to the first input 1 of the AND-gate $G_{52}$. The output of the AND-gate $G_{52}$ is connected to the reset input R of the fifth flip-flop $FF_5$ the output of which leads to the second inputs 2 of the NAND-gates $G_{18}$ and $G_{53}$ respectively, as well as to the reset input R of the third flip-flop $FF_3$.

A switch which is constituted by a flip-flop $FF_3$, to whose input CP the bass pulses are applied, is provided for alternately switching from fundamental bass to alternating bass, for which purpose its outputs, as stated, are connected to second inputs of the EXCLUSIVE OR circuits $G_{40}$, $G_{41}$ and $G_{43}$. Moreover, the bass pulses are applied to the reset input R of a fourth flip-flop $FF_4$ having a clock input CP connected to the first input 1 of the AND-gate $G_{32}$.

The output Q of the chord memory $FF_2$ leads to the second input of the NAND-circuit $G_{16}$ and input 5 of the OR-circuit $G_{44}$.

The output of the second gate circuit $G_{33}$ is connected both to the clock input CP of a frequency divider FD, which divides its input frequency by two, and to the first input 1 of the AND gate $G_{35}$. The second input 2 of AND gate $G_{35}$ is connected to the output Q of the fourth flip-flop $FF_4$ via an inverter stage $I_4$, to which output Q the first input 1 of the AND gate $G_{36}$ is also connected. The output Q of the frequency divider FD leads to the second input of the AND gate $G_{36}$.

The operation of this circuit is as follows: When a bass pulse bsp arrives the HF clock generator CPG, which is disabled by the $\overline{Q}$ output of the first flip-flop $FF_1$, which is "H" (high), is caused to produce a clock pulse at its output, so that the first 12-bit shift register $SR_1$, whose parallel enable input $\overline{PE}$ is initially "L" (low), receives an "L" at those parallel inputs for which the corresponding keys are depressed, and a "H" bit at the remaining parallel inputs. The second 12-bit shift register $SR_2$, whose parallel enable input $\overline{PE}$ is still also "L", receives an "H" bit at its parallel input $P_{12}$ and an "L" bit at the inputs $P_1 \ldots P_{11}$. Moreover, the flip-flops $FF_1$ and $FF_2$ are changed over and STW and consequently the $\overline{K}$ input of $FF_1$ is "H" so that the bits entered into the 12-bit shift registers $SR_1$ and $SR_2$ are stored, because now the output Q of flip-flop $FF_1$ is "H" and the output $\overline{Q}$ is "L", so that the HF clock generator CPG is started via its second input 2.

Initially the output Q of the flip-flop $FF_2$ is either "L" when a chord is sensed, or "H" when this is not the case. Since output Q of flip-flop $FF_1$ is still "L", the output of $G_{15}$ is still also "L" so that the "L" information is transferred from the preset inputs $P_0$, $P_1$, $P_2$ and $P_3$ of the counter CT to its outputs $Q_0$, $Q_1$, $Q_2$, and $Q_3$ upon the first transition from "L" to "H" of the HF clock pulse, i.e. the counter CT is reset to 0. Simultaneously, the parallel enable to reset input $\overline{PE}$ returns to "H" so that the counter is advanced one position upon each subsequent HF clock pulse. Moreover, output Q of the flip-flop $FF_2$, when it should still be "L", will also become "H" at said transition.

Each subsequent HF clock pulse from the HF clock generator CPG shifts the chord pattern entered into the first 12-bit shift registers $SR_1$ one position to the left, which pattern corresponds to the chord being held, for example the G-major chord, so that the outputs $Q_8$, $Q_{12}$ and $Q_3$ are initially "L". In the present example the chord pattern reaches the position of the C-major chord after seven steps, i.e. $Q_1$, $Q_5$ and $Q_8$ becomes "L", so that the output of NAND gate $G_{14}$ also becomes "L" and the chord has thus been detected. The same applies when the G-seventh chord GBDF is being held, depressing the combination GF being already sufficient.

The pattern "H" at output $Q_{12}$ in the second 12-bit shift register $SR_2$ has then arrived at the output $Q_7$ via the output $Q_1$ because this pattern is shifted to the right.

As soon as the chord is detected and the output of the NAND gate $G_{14}$ becomes "L", the detection of the chord is stored because the flip-flop $FF_2$ is changed over by the rising edge of the next HF clock pulse, so that output Q of flip-flop $FF_2$ becomes "L" again and remains in this state, even when the K input becomes "H" again. This transition no longer has any effect because the $\overline{J}$ and $\overline{K}$ inputs of flip-flop $FF_2$ remain "H" since the output Q of flip-flop $FF_1$ remains "H". In the time interval in which after the rising edge of the 7th pulse the output of the NAND gate $G_{14}$ becomes "L" and the output Q of the flip-flop $FF_2$ remains high until the rising edge of 8th clock pulse, the parallel enable or reset input $\overline{PE}$ of the counter CT becomes "L" so that the counter CT is reset. This 8th clock pulse transfers the pattern "H" from the second 12-bit shift register $SR_2$ to the output $Q_8$, which corresponds to the tone G, of the AND gate $G_{28}$.

The HF clock generator CPG now keeps running and shifts both the chord pattern in the first 12-bit shift register $SR_1$ further, which has no further effect on the process, and the charge pattern "H" in the second shift register $SR_2$, the counter CT, which has been reset to "0", being advanced.

As shifting the chord pattern in the first 12-bit shift register $SR_1$ is no longer necessary when the chord has been found it is as a matter of fact equally possible to interrupt a further supply of clock pulses to said 12-bit shift register $SR_1$ by disconnecting the clock pulse generator CPG from the clock input CP by means of a switch or gate circuits.

When the bass pulse bsp appears switch $FF_3$ is set to such a position that its output Q is "L" and its output $\overline{Q}$ is "H" and that consequently the second inputs of the EXCLUSIVE OR gates $G_{40}$ and $G_{41}$ are "L" and the second inputs of the EXCLUSIVE OR gates $G_{42}$ and $G_{43}$ of the comparator circuit are "H".

When the state of the first inputs of these EXCLUSIVE OR gates is the same as the state of the second inputs, i.e. both "H" or both "L", the outputs are "L". This case occurs when the outputs $Q_0$ and $Q_1$ of the counter CT are "L" and the outputs $Q_2$ and $Q_3$ are "H", i.e. for counter position 12 (1100). The charge pattern "H" of the second 12-bit shift register $SR_2$ has then also been shifted 12 positions further since the chord was detected and then again appears at the output $Q_8$.

The output of the OR gate $G_{44}$, which also is a part of the comparator circuit C, then becomes "L". As the output Q of the fifth flip-flop $FF_5$ is "L", the output of the NAND gate $G_{53}$ is "H" and the output of the AND gate $G_{17}$ consequently becomes "L". Therefore a negative pulse appears at the reset input $\overline{R}$ of the flip-flop $FF_1$, as a result of which the output Q of the flip-flop $FF_1$ becomes "L" again; the parallel-enable inputs $\overline{PE}$ of the counter CT and the two 12-bit cyclic shift registers $SR_1$ and $SR_2$ then become "L". The output $\overline{Q}$ of the flip-flop $FF_1$ becomes "H", as a result of which the HF clock pulse generator is stopped and the circuit has returned to its initial state.

The 5th input of the OR gate $G_{44}$, which becomes "L" after the chord is detected, has been provided to prevent the flip-flop $FF_1$ from being stopped prematurely during chord sensing in the case of correspondence of the count of the counter CT and the number supplied by the flip-flop $FF_3$.

Each time that the charge pattern "H" passes the output $Q_{12}$ of the second 12-bit shift register $SR_2$, the flipflop $FF_4$ changes over. When its output Q is "L" and consequently the output of the fourth inverter $I_4$ is "H", a tone G is transferred for reproduction by the AND gate $G_{35}$ with the aid of the OR gate $G_{37}$. Gate $G_{36}$ is then blocked because its first input 1 is "L".

In the present instance the charge pattern "H" passes the output $Q_{12}$ of the second 12-bit shift register $SR_2$ twice so that both the fundamental and the quint are reproduced in their original key.

When the fundamental is C, C-sharp, D or D-sharp, the charge pattern "H" passes the output $Q_{12}$ only once for the quint, and consequently the flip-flop $FF_4$ remains set, so that the quints corresponding to these tones, G, G-sharp, A, A-sharp, are transferred one octave lower from the NAND gate $G_{36}$ to the OR gate $G_{37}$ via the frequency divider FD. When the next bass pulse bsp arrives the entire process is repeated, but since this bass pulse changes over the switch $FF_3$ so that its output Q becomes "H", the second inputs of the EXCLUSIVE-OR gates $G_{40}$, $G_{41}$ and $G_{42}$ now become "H" and those of the EXCLUSIVE-OR gate $G_{43}$ become "L". This situation corresponds to the digit (0111), i.e. to the quint D, so that now the charge pattern "H" of the second 12-bit shift register remains at the output $Q_3$ of said register. As in the meantime the fourth flip-flop $FF_4$ has been reset by the bass pulse bsp, and the charge pattern does not pass the output $Q_{12}$ of the second 12-bit shift register, the flip-flop $FF_4$ remains in this state and the AND gate $G_{35}$ is blocked so that the tone frequency, which has been divided by 2 by the frequency divider FD, is transferred for reproduction from the AND gate $G_{36}$ by means of the OR gate $G_{37}$. This is the case when the alternating bass, i.e. the quint, is reproduced whose frequency consequently always lies below the fundamental bass in a musically correct manner.

If no chord is detected, the counter CT transfers a "H" at the count of 12 (1100) via its outputs $Q_2$ and $Q_3$, which are "H", with the aid of the AND-gate $G_{50}$, to the inverter $I_5$ and thus an "L" to the first input 1 of the AND gate $G_{51}$, so that the parallel enable or reset input $\overline{PE}$ of the counter CT becomes "L". Simultaneously, the counter CT transfers a "H" the clock input CP of the fifth flip-flop $FF_5$, whose K-input is "H" and whose "J"-input is "L". Upon the next clock pulse from the HF clock generator CPG the counter CT is reset and its outputs $Q_2$ and $Q_3$, the output of the AND-gate $G_{50}$ and the clock input CP of the fifth flip-flop $FF_5$ becomes "L". This flip-flop $FF_5$ is changed over on the trailing edge of said pulse so that its output Q becomes "H", and the second input of the NAND gate $G_{18}$ becomes "H", as a result of which the chord sensor CS is now changed over to tone identification. At the same time the parallel enable or reset input $\overline{PE}$ of the counter CP becomes "H" again so that the counter CT is restarted and the flip-flop $FF_3$ is reset.

If for example the E-key had been depressed, the first 12-bit cyclic shift register $SR_1$ receives an "L" at the fifth parallel input $P_5$.

This "L" information is shifted by twelve steps and when the count 12 (1100) of the counter CT is reached it is again available at the parallel output $Q_5$. The "H" information in the second 12-bit cycle shift register is at the same time available at the output $Q_{12}$.

After four more steps the "L" information has reached the parallel output $Q_1$ of the first 12-bit cyclic shift register $SR_1$ and via inverter $I_1$ the first input 1 of the AND-gate $G_{18}$, whose second input was already "H", also becomes "H". The output of this gate and thus the $\overline{K}$ input of the chord detected memory $FF_2$ becomes "L" so that the identification of the tone is stored since $FF_2$ is changed over upon the rising edge of the next clock pulse from the HF clock generator CPG. As a result the output Q of the flip-flop $FF_2$ becomes "L" and remains in this state when the $\overline{K}$-input becomes "H" again.

In the time interval in which after the rising edge of the fourth pulse from the HF clock generator CPG upon the first reset of the counter CT the output of the NAND-gate $G_{17}$ becomes "L" and the output Q of the flip-flop $FF_2$ remains "H" until the rising edge of the fifth clock pulse, the parallel-enable or reset input $\overline{PE}$ of the counter CT becomes "L", in that the first input of the AND-gate $G_{51}$ becomes "L", so that the counter is reset. This fifth clock pulse transfers the "H" information from the second 12-bit shift register $SR_2$ to the output $Q_5$, which corresponds to the tone E of the AND-gate $G_{25}$. As flip-flop $FF_5$ has been reset, it is ensured that the output of the comparator circuit C becomes "L" for the count 12 (1100) of the counter CP, so that the first input of the AND-gate $G_{52}$ becomes "L" and thus the R-input of the fifth flip-flop $FF_5$ becomes "L". Thus the flip-flop $FF_5$ is reset, and furthermore the first input 1 of the AND-gate $G_{17}$ becomes "L" and a negative pulse is applied to the $\overline{R}$-input of the first flip-flop $FF_1$, so that the output Q of the flip-flop $FF_1$ becomes "L" again. Thus the parallel enable or reset inputs $\overline{PE}$ of the counter CT and of the two 12-bit cyclic shift registers $SR_1$ and $SR_2$ become "L". The output $\overline{Q}$ of the flip-flop $FF_1$ becomes "H" so that the HF clock generator CPG is stopped and the circuit is again in its original state. In the meantime the "H" information has been shifted through the second 12-bit cyclic shift register $SR_2$ is twelve steps after a chord has been detected and is again available at the output $Q_5$.

FIG. 4a illustrates this process by means of pulse-time diagrams.

If no key is depressed, the counter CT directly continues to its count 12 (1100). At this count the outputs $Q_2$ and $Q_3$ of the counter CT becomes "H" so that the output of the AND-gate $G_{50}$ and the first input 1 of the NAND-gate $G_{53}$ become "H". As the output Q of the fifth flip-flop $FF_5$ and thus the second input 2 of the NAND-gate $G_{53}$ were still "H", the output of this NAND-gate becomes "L", so that a negative pulse is applied to the $\overline{R}$-input of the first flip-flop $FF_1$ via the AND-gate $G_{17}$ and thus the process of stopping the entire circuit is initiated, as in the case of chord or tone detection. Furthermore, the second input 2 of the AND-gate $G_{52}$ and thus the reset input $\overline{R}$ of the fifth flip-flop $FF_1$ become "L" so that this flip-flop is reset. FIG. 4b shows the corresponding waveform diagrams.

Without additional steps the second 12-bit cyclic shift register $SR_2$ would transfer the signal at the output $Q_1 \ldots Q_{12}$, at which the "H" information is available during stopping, to the associated AND-gate $G_{21} \ldots G_{32}$, so that an arbitrary tone is reproduced.

In order to prevent this, the signal at the output of the NAND-gate $G_{53}$ is also applied to the reset input $\overline{C}_L$ of the second 12-bit cyclic shift register $SR_2$, so that the "H" information also becomes "L" and the AND-gates $G_{21} \ldots G_{32}$ can no longer transfer any tone.

In this circuit arrangement the counter thus performs a double function:

(1) with the comparator circuit C and the switch $FF_3$ change-over is effected from fundamental to alternating bass, and (2) with the decoder $G_{50}$ i.e. AND-gate $G_{50}$ change-over from chord detection to tone detection is effected.

FIG. 5 shows a circuit arrangement in which the second 12-bit cyclic shift register $SR_2$ is used as a counter and decoder with its twelfth parallel output $Q_{12}$ connected to the set input CP of the flip-flop $FF_5$.

Upon the appearance of a bass pulse bsp the process described above is performed, except for the following: Upon the appearance of a first clock pulse from the HF clock pulse generator CPG the "H" information is transferred to the twelfth parallel input $P_{12}$ of the second 12-bit cyclic shift register $SR_2$ and appears at the parallel output $Q_{12}$. The parallel enable or reset input $\overline{PE}$ of the counter CT remains "L" via the NAND-gate $G_{54}$, whose first input 1 is "H", until the "H" information is shifted one position further upon the next clock pulse. This does not affect the rest of the process because the counter CT is reset when a chord or a tone again is detected.

When upon detection of a chord the output Q of the chord-detected memory $FF_2$ becomes "L" and thus the reset input R of the fifth flip-flop $FF_5$ becomes "L" via the AND-gate $G_{52}$, it is prevented that said fifth flip-flop $FF_5$ and thus $FF_3$ is changed-over when the "H" information appears at the output $Q_{12}$ of the second 12-bit cyclic shift register $SR_2$ because the output Q of the fifth flip-flop $FF_5$ then becomes "H".

As the output Q of the flip-flop $FF_2$ is "L", it is moreover prevented with the aid of the NAND-gate $G_{54}$ that the "H" information resets the counter CT, so that the normal process in the case of chord identification is performed.

If no chord is detected, the "H" information, upon its appearance at the output $Q_{12}$ of the second 12-bit cyclic shift register $SR_2$, is applied to the input $\overline{PE}$ of the counter CT as "L" via the NAND-gate $G_{54}$ and the AND-gate $G_{51}$, whose first inputs are "H", so that said counter is reset, and moreover it is transferred to the clock input CP of the fifth flip-flop $FF_5$ so that said flip-flop $FF_5$ changes over on the trailing edge of the "H" information and its output Q and the second input 2 of the NAND-gate $G_{18}$ becomes "H".

If the E-key is depressed again and an "L" has been transferred to the fifth parallel input $P_5$, said "L" information appears at the first parallel output $Q_1$ after four steps in the first 12-bit shift register $SR_1$. As a result the $\overline{K}$-input of the chord-detected memory $FF_2$ becomes "L" via the first inverter and the NAND-gate $G_{18}$ and the chord-detected memory $FF_2$ changes-over upon the trailing edge of the next clock pulse from the HF clock generator CPG, so that its output Q becomes "L".

This last-mentioned clock pulse transfers the "H" information at the parallel output $Q_4$ of the second 12-bit cyclic shift register $SR_2$ to the parallel output $Q_5$ which corresponds to the tone E.

As the output Q of the chord-detected memory $FF_2$ becomes "L", and the output $\overline{Q}$ becomes "H", the first input 1 of the gate $G_{53}$, whose second input 2 is still "H" because the output Q of the fifth flip-flop $FF_5$ is still "H", becomes "H" via the OR-gate $G_{55}$, so that via the AND-gate $G_{17}$ the stop process is initiated. Moreover, via its R-input, the fifth flip-flop $FF_5$ is reset and its output Q becomes "L". In order to enable a sufficiently wide stop pulse to be obtained at the output of the NAND-gate $G_{53}$, the change from "H" to "L" of the second input 2 of this NAND-gate $G_{53}$ can be delayed at option, for example by the inclusion of a suitable number of inverters between this second input 2 and the output Q of the fifth flip-flop $FF_5$. FIG. 6*a* illustrates this process by means of waveform diagrams.

If no key is depressed at all, when the "H" information arrives for the second time at the parallel output $Q_{12}$ of the second 12-bit cyclic shift-register, an "H" is applied to the first input of the NAND-gate $G_{53}$, whose second input 2 is still "H", via the OR-gate $G_{55}$, so that the stop process is also initiated. The output Q of the chord-detected memory $FF_2$ remains "H" and its output Q remains "L" so that, via the OR-gate $G_{56}$ at the reset input $\overline{C}_L$, the second 12-bit cyclic shift register $SR_2$ is reset and no tone is reproduced.

FIG. 6*b* shows the corresponding waveform diagrams.

What is claimed is:

1. A device for automatic tonal accompaniment in electronic musical instruments equipped with a rhythm unit, the fundamental, the quint or another tone related to specific chords being held and/or the chord itself becoming available in a predetermined sequence in the selected rhythm, said device comprising chord sensor means responsive to at least one tonal key for producing at its output a first control signal in the presence of a chord, and switching means independent of the rhythm unit coupled to the associated chord sensor means for producing a second control signal identifying individual tones in the absence of a chord.

2. A device for automatic tonal accompaniment in electronic musical instruments equipped with a rhythm unit, the fundamental, the quint or another tone related to specific chords being held and/or the chord itself becoming available in a predetermined sequence in the selected rhythm, said device comprising chord sensor means responsive to at least one tonal key for producing at its output a first control signal in the presence of a chord, and switching means coupled to the associated chord sensor means for producing a second control signal identifying individual tones in the absence of a chord, and wherein the chord sensor means includes a chord sensor for each tonal key, and the switching means includes twelve switches each having first and second inputs, an output, and at least one control input for the twelve switches, means for applying the tones of the chords to be detected to the inputs of respective chord sensors, means connecting the output of each chord sensor both to a first input of one of the twelve switches and to an input of an OR-gate, means for applying to the second inputs of the twelve switches a key signal of a preselected tone of the chord, means connecting the output of said OR-gate to the one control input of the twelve switches, means connecting the output of each of the switches to an input of a priority circuit having an output for each input, a plurality of other switches each having first and second inputs and a control input, means connecting each output of said priority circuit to a respective control input of said other switches, means for applying to the first input of said other switches the corresponding tone and to the second input thereof a control pulse from the rhythm unit, and means interconnecting the outputs of said other switches via an OR-circuit.

3. A device as claimed in claim 2, where in the other switches comprise and AND-gate circuit having a control input connected to the output of the priority circuit, a second input that receives pulses from the rhythm unit and a first input that receives a tone signal.

4. A device as claimed in claim 2 wherein each said other switch comprises first and second AND-gate circuits whose control inputs are both connected to an output of the priority circuit, means applying the signal corresponding to the fundamental of the chord sensor to the first input of the first gate circuit, means applying the fundamental bass pulses from the rythm unit to the second input of the first gate circuit, and means applying the signal which corresponds to the alternating bass of the chord sensor to the first input of the second gate circuit and the alternating bass pulses from the rhythm unit to the second input of the second gate circuit.

5. A device as claimed in claim 1, wherein the device comprises:

(a) a first 12-bit cyclic shift register having twelve parallel inputs, twelve corresponding outputs, a parallel enable input and a clock input, (b) chord sensor means including a chord sensor which identifies the character of a chord being held, (c) A HF clock generator having at least one input and an output, (d) A second 12-bit cyclic shift register having 12 parallel inputs, twelve corresponding outputs, a parallel enable input and a clock input, (e) twelve first gate circuits each having two inputs and an output, (f) a second gate circuit having twelve inputs and one output, and (g) a control unit, means connecting the outputs of the manual and/or pedal key switches associated with the manual and/or pedal keys of at least one octave to the parallel inputs of the first 12-bit cyclic shift register, means for applying a control pulse from the rhythm unit to the parallel enable input of the first 12-bit cyclic shift register thereby to transfer the pattern of the chord being held in parallel to said first 12-bit cyclic shift register, means connecting to the inputs of the chord sensor those outputs of the first 12-bit cyclic shift register to which the tones of the chords of a single tonal key correspond, means connecting the output of the HF clock generator to the clock input of the first and second 12-bit cyclic shift register, each HF clock pulse shifting the information at the driven parallel inputs of the first shift register, which information corresponds to the pattern of the chord being held, one position further, one single bit being entered into the second shift register with each control pulse via one of its twelve parallel inputs, each HF clock pulse shifting the information at the driven parallel input one position further, means connecting to inputs of the chord sensor those outputs of the first 12-bit cyclic shift register to which the tones of the chords of a single tonal key to be reproduced correspond, the chord sensor producing at its output a signal when a chord is detected which signal is applied to the control unit, the HF clock generator being rendered effective in response to each control pulse, means connecting the control unit to the input of the HF clock generator so that the HF clock generator is rendered ineffective, means connecting each output of the second 12-bit cyclic shift register to a respective first input of an associated one of the twelve separate first gate circuits, means applying to a respective second input of the twelve first gate circuits respective tone signals, means connecting the outputs of the twelve first gate circuits to the corresponding inputs of the second gate so that at the output of the second gate circuit a tone signal becomes available, and a counter connected to the switching means which, after twelve clock pulses from the HF clock generator, causes the switching means to switch the chord sensor to individual tone detection.

6. A device as claimed in claim 5, wherein the outputs of the counter are connected to a decoder at whose output a signal appears upon receipt of a twelfth HF clock pulse, said output being connected to an input of the switching means, an output of the switching means being connected to an output of the chord sensor for switching the chord sensor to tone detection, and a reset input of the switching means being connected to a stop input of the control unit so that the switching means is reset upon detection of a tone.

7. A device as claimed in claim 5, wherein the output of the chord sensor is connected to an input of a chord memory device included in the control unit and which stores the identified chord, a second output of the control unit coupling the output of said chord memory device to a reset input of the counter, a clock input of the counter also being connected to the output of the HF clock generator, a comparator circuit having first inputs connected to the corresponding outputs of the counter and having second inputs connected to a switch which changes over upon receipt of each control pulse, the output of the comparator circuit being connected to a third input of the control unit so that alternately when that count of the counter is reached which corresponds to the fundamental or to another tone, the HF clock generator is rendered ineffective, the third and the fourth output of the counter being connected via a decoder to the input of the switching means, to a reset input of the counter via an AND-gate and to the first input of a NAND-circuit, the second input of the NAND-circuit being connected to an input of the chord sensor, to the output of the switching means and to the reset input of the switch, the output of the NAND circuit being connected to the reset input of the second 12-bit cyclic shift register, to the reset input of the switching means and to a stop input of the control unit, the output of the comparator circuit being connected to the reset input of the switching means.

8. A device as claimed in claim 6, wherein the counter and the decoder for switching to tone detection comprise the twelfth parallel output of the second 12-bit cyclic shift register, said twelfth parallel output being connected to an input of the switching means.

* * * * *